US010898000B2

(12) United States Patent
Romano et al.

(10) Patent No.: US 10,898,000 B2
(45) Date of Patent: Jan. 26, 2021

(54) LEG EXTENSION FOR PROCEDURE CHAIR

(71) Applicant: United Metal Fabricators, Inc., Johnstown, PA (US)

(72) Inventors: Joseph Romano, Johnstown, PA (US); Quinn Carpenter, Johnstown, PA (US)

( * ) Notice: Subject to any disclaimer, the term of this patent is extended or adjusted under 35 U.S.C. 154(b) by 179 days.

(21) Appl. No.: 16/046,546

(22) Filed: Jul. 26, 2018

(65) Prior Publication Data

US 2020/0029696 A1 Jan. 30, 2020

(51) Int. Cl.

| | |
|---|---|
| ***A47C 7/50*** | (2006.01) |
| ***A61G 15/12*** | (2006.01) |
| ***A61G 15/02*** | (2006.01) |

(52) U.S. Cl.

CPC ..... *A47C 7/5068* (2018.08); *A47C 7/5062* (2018.08); *A61G 15/02* (2013.01); *A61G 15/12* (2013.01)

(58) Field of Classification Search

CPC ..... A47C 7/50; A47C 7/506; A47C 7/5062; A47C 7/5066; A47C 7/5068; A61G 15/12; A61G 15/02

See application file for complete search history.

(56) References Cited

U.S. PATENT DOCUMENTS 1,262,216 A 4/1918 Lee
2,604,146 A * 7/1952 Martin ..... A47C 7/506 297/423.22
2,605,151 A * 7/1952 Shampaine ..... A61G 13/0009 5/602
2,712,484 A 7/1955 Adolphson
3,334,951 A * 8/1967 Douglass, Jr. ..... A61G 13/0018 312/209
4,034,972 A * 7/1977 Peterson ..... A61G 7/015 5/618
4,376,317 A 3/1983 Johnston
4,409,695 A 10/1983 Johnston et al.
4,508,387 A * 4/1985 Gilbert ..... A61G 13/12 297/423.19
4,529,185 A * 7/1985 Gutierres ..... A61G 13/0018 5/600

(Continued)

FOREIGN PATENT DOCUMENTS

EP 1116654 B1 1/2001

*Primary Examiner* — David R Hare
(74) *Attorney, Agent, or Firm* — Metz Lewis Brodman Must O'Keefe LLC

(57) ABSTRACT

An extension assembly for a procedure chair leg pad includes a frame and a leg pad assembly. The frame attaches to deployment tracks of the procedure chair through frame arms and includes a slot(s). At least one slot includes detents configured to receive and selectively restrain a guide member. The leg pad assembly is disposed in proximity to the frame and includes a guide member(s) extending therefrom, through a slot and movable relative to the frame. The leg pad assembly may be moved forward and rearward by manual adjustment, moving the guide members through their respective slots. Detents along the slots restrain the guide member at predefined positions until sufficient force is applied to overcome the geometry of the detent. A detent(s) is configured to prevent vertical movement of the leg pad assembly when stowed vertically, but still allow movement in a deployed position.

19 Claims, 4 Drawing Sheets

(56) References Cited

U.S. PATENT DOCUMENTS

| | | | | |
|---|---|---|---|---|
| 4,968,013 | A * | 11/1990 | Kuck | A61G 13/10 5/600 |
| 5,005,667 | A * | 4/1991 | Anderson | A47B 77/10 182/15 |
| 5,052,378 | A | 10/1991 | Chitwood | |
| 6,295,987 | B1 | 10/2001 | Parker et al. | |
| 6,926,366 | B2 | 8/2005 | Wolters | |
| 7,350,249 | B2 | 4/2008 | Jacobs et al. | |
| 7,512,998 | B2 | 4/2009 | Martin et al. | |
| 7,665,166 | B2 | 2/2010 | Martin et al. | |
| 7,669,259 | B2 | 3/2010 | Ganance et al. | |
| 7,774,873 | B2 | 8/2010 | Martin et al. | |
| RE43,532 | E | 7/2012 | Menkedick et al. | |
| 8,651,591 | B1 | 2/2014 | Chen et al. | |
| 9,038,216 | B2 * | 5/2015 | Buege | A61G 13/0018 5/611 |
| 2002/0108178 | A1 | 8/2002 | Francois | |
| 2004/0068797 | A1 * | 4/2004 | Smith | A61G 13/06 5/617 |
| 2005/0102755 | A1 * | 5/2005 | Jacobs | A61G 15/00 5/624 |
| 2005/0151408 | A1 | 7/2005 | Pratte et al. | |
| 2010/0201169 | A1 | 8/2010 | Fox et al. | |
| 2015/0342805 | A1 | 12/2015 | Harris, Jr. | |
| 2020/0038275 | A1 * | 2/2020 | Romano | A61G 13/1245 |
| 2020/0046296 | A1 * | 2/2020 | Romano | A61B 5/021 |

* cited by examiner

LEG EXTENSION FOR PROCEDURE CHAIR

FIELD OF THE INVENTION

This invention relates to procedure chairs used in various medical fields, and more particularly, to a mechanism for extending the leg pad of a procedure chair.

BACKGROUND

Procedure chairs are used prolifically in the medical industry, including but not limited to ear nose and throat (ENT), podiatry, proctology, dentistry, and dermatology. These procedure chairs are typically powered and use motors to electrically position the various parts of the chair. For instance, power procedure chairs may adjust vertically up and down at the base, the legs may be raised and lowered by rotation from a stored position against the base, the back may be raised and lowered between a sitting position and supine position, and the seat may tilt forward and back or side to side. All these adjustments may be made to better position the patient according to the procedure being performed and/or for patient comfort during a procedure. However, the Americans with Disabilities Act of 1990 (ADA) requires the seat of procedure chairs to be no more than 17-19 inches from the ground so individuals in wheelchairs can access and transfer themselves into and out of the procedure chairs. Compliance with this ADA requirement therefore limits the length of the leg pad to a maximum of 17-19 inches since the leg pad is stowed vertically against the base of the procedure chair and under the seat. The result is that the leg pad is often too short to fully support a patient's legs when deployed, particularly patients with longer legs, leaving the patient's feet to dangle off the edge. It would be beneficial to have a way to meet ADA compliance and still fully support the legs and feet of patients when in use.

SUMMARY

An extension assembly for a procedure chair leg pad is disclosed having slots and detents for selective extension of the leg pad in a deployed position. The detents mark various positions at which the extension assembly may be secured, though not locked, depending on the amount of extension desired. The detents also secure the extension assembly from slippage when in the vertical stowed position without being locked, allowing for secure stowage as well as easy and quick use.

The extension assembly, together with its particular features and advantages, will become more apparent from the following detailed description and with reference to the appended drawings.

DESCRIPTION OF THE DRAWINGS

Like reference numerals refer to like parts throughout the several views of the drawings.

DETAILED DESCRIPTION

Figure 1:
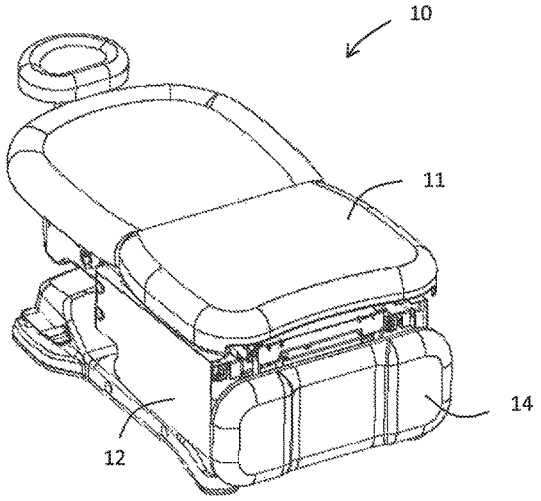
FIG. 1 is an isometric view of a procedure chair with the leg pad in the stowed vertical position.
Figure 2:
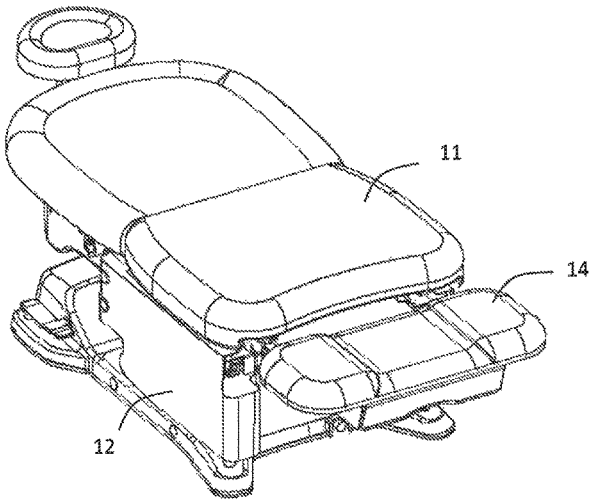
FIG. 2 is an isometric view of the procedure chair of FIG. 1, with the leg pad in a deployed position.
Figure 3:
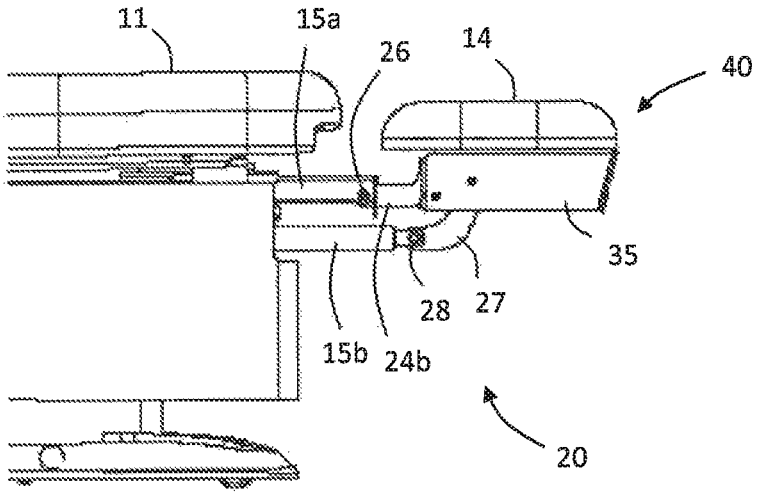
FIG. 3 is a side elevation view of the end of the procedure chair, showing the leg pad in a deployed position.

As shown in the accompanying drawings, the present invention is directed to an extension assembly 20 for use with the leg pad 14 of a procedure chair 10. FIGS. 1 and 2 show an exemplary procedure chair 10, which may be a power procedure chair that uses motors to adjust various aspects of the procedure chair 10 such as described above. In a stowed position, shown in FIG. 1, the leg pad 14 is vertically positioned beneath the seat cushion 11 and against the base 12 of the procedure chair 10. The leg pad 14 may be moved to a deployed position as shown in FIGS. 2 and 3 by motors moving the leg pad 14 out away from the base 12 along deployment tracks 15*a*, 15*b* and rotating the leg pad 14 up. These adjustments may be mechanized or motorized and may occur separately in any order or simultaneously. Once in a deployed position, the leg pad 14 may still not be spaced far enough from the seat cushion 11 to support the entire legs and feet of a patient, particularly if they have long legs. This is due in part to the shorter length of leg pad 14 required under the ADA requirements for procedure chairs that limits the length to 17-19 inches.

Figure 4:
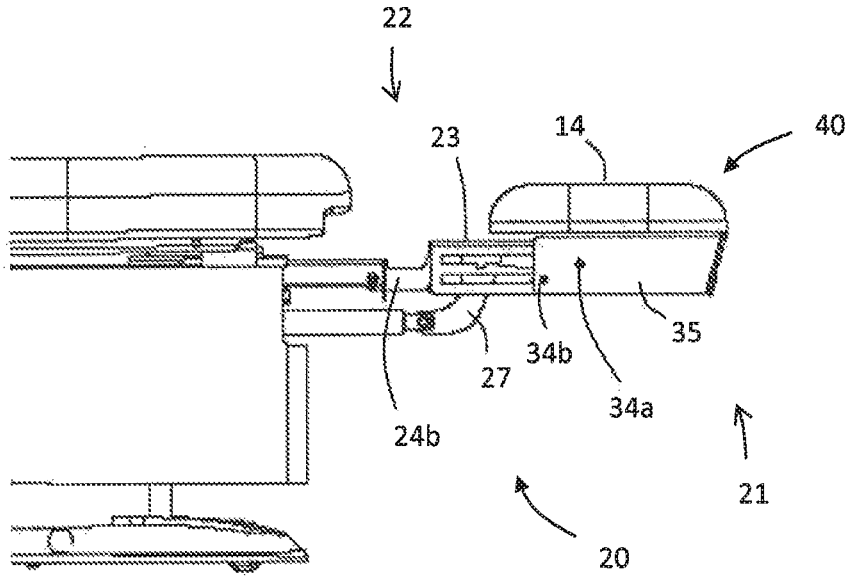
FIG. 4 is a side elevation of the end of the procedure chair of FIG. 3 but showing the leg pad extended with the present extension assembly.

The present invention solves this problem with an extension assembly 20 that may be actuated to extend the leg pad 14 in a forward direction, as shown in FIG. 4, to a number of extension positions. As used herein, "forward" or "distal" refers to the direction away from the procedure chair 10, and "rearward" or "proximal" refers to the direction toward the procedure chair 10. The extension assembly 20 may be operated manually, such as by a practitioner pulling on the leg pad 14. The extension assembly 20 is not locked at any point, permitting selective movement whenever the practitioner desires.

Figure 5:
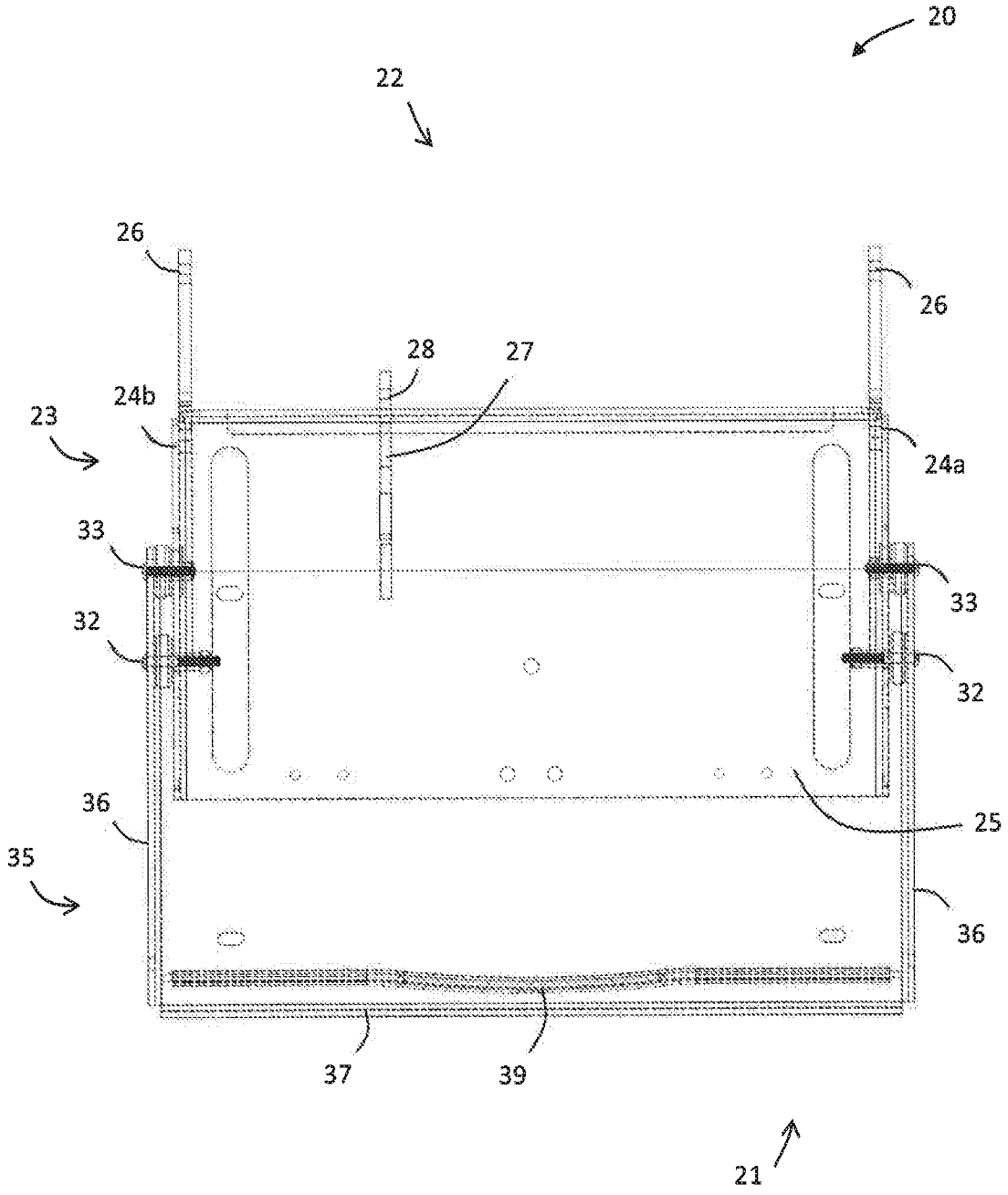
FIG. 5 is a top plan view of the extension assembly of the present invention.
Figure 6A:
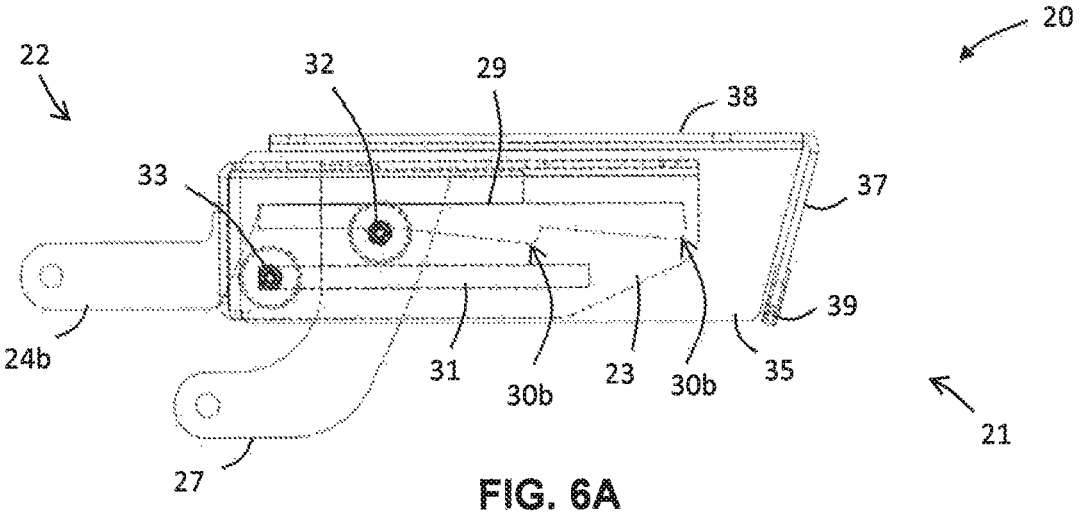
FIG. 6A is a side view diagram of the extension assembly in an initial deployed position.
Figure 6B:
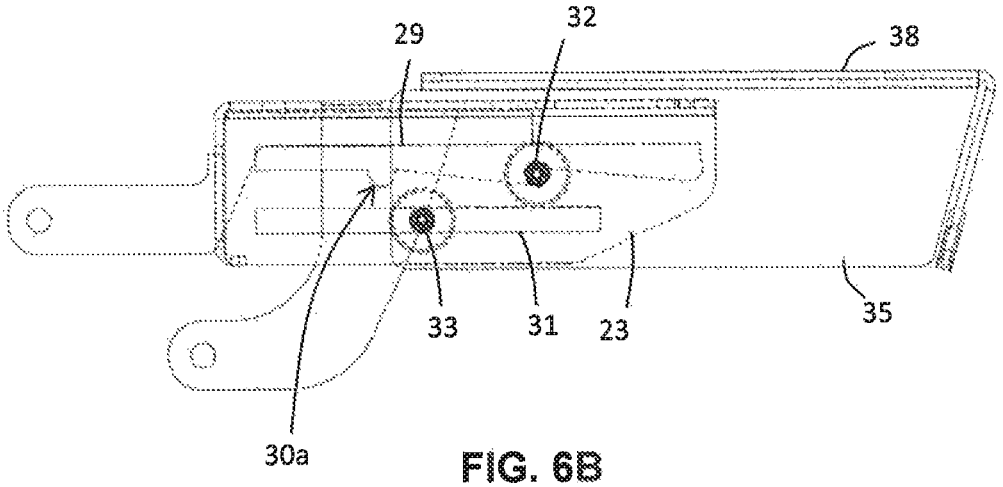
FIG. 6B is a side view diagram of the extension assembly in an intermediate extension position.
Figure 6C:
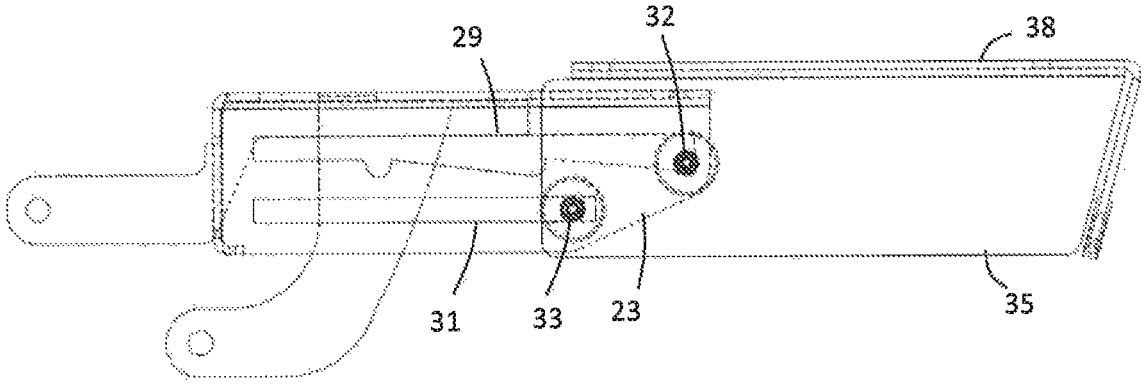
FIG. 6C is a side view diagram of the extension assembly in a fully extended position.

FIGS. 5-6C show the extension assembly 20 of the present invention. The extension assembly 20 includes a frame 23 having the movement mechanism. The frame 23 includes at least one, but preferably a pair of frame arms 24*a*, 24*b* having a length defined by a forward end 21 of the assembly 20 and a rearward end 22 of the assembly 20. The frame arms 24*a*, 24*b* may be disposed at a fixed distance relative to one another, and as such may be parallel to one another, and are of a rigid construction to provide structure to the extension assembly 20. For example, the frame arms 24*a*, 24*b* may be made of any rigid material, such as but not limited to metals like steel, aluminum, alloys, and hard plastic. Each frame arm 24*a*, 24*b* may include a frame pivot point 26 at the rearward end of the frame arm 24*a*, 24*b* where the frame aria 24*a*, 24*b* connects to the deployment tracks 15*a* of the procedure chair 10 and about which the extension assembly 20 is rotated upward during initial powered deployment.

The frame 23 may also include a crossover panel 25 extending between and joining the frame arms 24*a*, 24*b*. Accordingly, the crossover panel 25 may define the width of the extension assembly 20. In at least one embodiment, the crossover panel 25 may extend transversely or perpendicularly to the longitudinal axis of the frame arms 24*a*, 24*b*. The crossover panel 25 may also be of rigid construction, such as metals like steel, aluminum, alloys, and hard plastics, and is secured to the frame arms 24*a*, 24*b*. The crossover panel 25 may connect to the frame arms 24*a*, 24*b* at any point there along, which may be at different points on one frame arm 24*a* and the other frame arm 24*b*. In at least one embodiment, the crossover panel 25 joins the frame arms 24*a*, 24*b* at the forward ends thereof. The crossover panel 25 may be securely affixed to the frame arms 24*a*, 24*b*, such as by welding, soldering, adhesive, or other similar mechanism, or in some embodiments may be integrally formed therewith, such as by casting or molding of a unitary piece. A support arm 27 may connect to the crossover panel 25, such as to the underside thereof. The support arm 27 may be used to push the extension assembly 20 (and attached leg pad 14) up during the rotation of deployment. The support arm 27 may therefore connect to a deployment track 15*b* at a support arm pivot point 28 for this purpose. The support arm pivot point 28 may therefore be located at a rearward end of the support arm 27 and is opposite from the connection to the crossover panel 27 at the forward end.

Each frame arm 24*a*, 24*b* includes at least one slot, and may include a plurality of slots. In at least one embodiment, each frame arm 24*a*, 24*b* includes a first slot 29 and a second slot 31 extending through ac frame arm 24*a*, 24*b*. The first and second slots 29, 31 may extend along at least a portion of the length of each frame arm 24*a*, 24*b* between the forward and rearward ends, such as along a planar section thereof. The slots 29, 31 may not extend the entire length of the frame arms 24*a*, 24*b* in some embodiments. The slots 29, 31 may be the same length and dimension as one another or may be different from one another in length and/or dimension. The slots 29, 31 may be parallel to one another, or may be at an angle relative to one another. Each slot 29, 31 is at least dimensioned to slidingly receive a guide member 32, 33 inserted therethrough. For instance, the first slot 29 may be dimensioned to receive a first guide member 32 and the second slot 31 may be dimensioned to receive a second guide member 32. The guide members 32, 33 may be a pin, roller, peg, rod, wheel, bolt, bearing or other such connector as may be used to connect but also allow movement, such as by sliding or rotation.

At least one of the slots, such as the first slot 29, includes a plurality of detents 30 formed therein. There may be any number of detents 30 formed in the first slot 29 as the length of the first slot 29 permits. Each detent 30 corresponds to a different discrete position of the extension assembly 20 and may define different deployed positions. The detents 30 may be spaced apart from one another along the length of the first slot 29 and may be uniformly spaced apart or by different distances. The detents 30 are configured to receive and selectively restrain at least a portion of the guide member 32 therein, such as between forward and rearward edges of the detent 30. For instance, the detents 30 may be curved and may have a diameter that is substantially similar to that of the guide member 32. In some embodiments, the detents 30 may be angular, square, polygonal, or irregularly shaped as a few non-limiting examples.

In certain embodiments, the detents 30 may have different configurations from one another. For example, as shown in FIGS. 6A-6C, some detents 30*a* may have a semi-circular configuration to receive a majority of or substantially all the guide member 32 as it falls into the detent 30*a*, Such detents 30*a* may comprise a dip in the slot 29 and may have a depth substantially equal to the diameter of the guide member 32. Because of this depth or similar geometry, detent 30*a* may provide more robust restriction of forward movement and require the guide member 32 to be lifted out of the detent 30*a* before further movement is possible. Other detents 30*b* may have a shallower depth in at least one direction, such as in the rearward direction. Detents 30*b* may be curved or angled or a combination thereof. For instance, in at least one embodiment the detents 30*b* may be include a forward edge of sufficient height to receive and restrain a portion of the guide member 32 thereon and inhibit forward movement for a secure position, and include a more open configuration in the rearward direction, such as leading into an incline, for easier movement out of the position in the rearward direction. The guide member 32 may be selectively removed from such shallower detents 30*b* by additional force in the forward or rearward direction.

Although any type or configuration of detent 30*a*, 30*b* may be formed at any location along the first slot 29, in at least one embodiment the deeper detent(s) 30*a* may be positioned at rear of the first slot 29. The deeper detent 30*a*, having a greater contact area to receive the first guide member 32 along the bottom and sides of the detent 30*a*, means that it is capable of holding or preventing the movement of the first guide member 32 in the stowed vertical direction shown in FIG. 1. In the stowed position, the leg pad 14 is not extended at all, but fully retracted. The rearmost detent 30 is therefore engaged by the first guide member 32 in the stowed position. The greater contact area of detent 30*a* allows the first guide member 32 to rest against the detent 30*a* by gravity in the vertical stowed position. However, there is no locking mechanism and the first guide member 32 is not locked in the detent 30*a*. Despite not being locked, the first guide member 32 remains within the detent 30*a* in the vertical stowed position so the leg pad 14 is safely stowed, but is easily removed for forward movement when in a deployed position as in FIGS. 2 and 3. The present extension assembly 20, and specifically the geometry of the first slot 29 and detents 30*a*, 30*b*, therefore provides secure positioning of the leg pad 14 without the use of locking mechanisms so it is readily available and easily operated for forward extension movement.

The second slot 31 may not include detents 30, but rather may have a constant, uniform or uninterrupted dimension along its length in certain embodiments. This second slot 31 may be configured to movably receive the second guide member 33 therethrough. The second guide member 33 and second slot 31 may provide stability to the extension assembly 20 during the extension process, such as to prevent wobbling of the leg pad assembly 40 from rotation about the first guide member 32 during forward or rearward movement, or from weight applied by a patient's legs to the leg pad 14 once in use.

The extension assembly 20 further includes a leg pad assembly 40 correspondingly shaped to at least a portion of the frame 23 and slidably affixed thereto, as shown in FIGS. 3 and 4. The leg pad assembly 40 protects the moving parts of the extension assembly 20 and is manipulated to move between the various deployment positions illustrated in FIGS. 3-6C, which may be at least partially overlapping the frame 23. The leg pad assembly 40 includes the leg pad 14 and a cover 35 to which the leg pad 14 is connected. The leg pad 14 may be a separate piece secured or mounted to the cover 35, or may be integrally formed therewith. For instance, in some embodiments the leg pad 14 may include padding, upholstery, foam, and other resilient materials to absorb pressure and provide comfortable support to a patient's legs placed thereon. Such soft or resilient material may be made separately and mounted to the cover 35, such as with screws, nails, bolts, adhesive, hook and loop fasteners, or other suitable fastening members. The cover 35 may include an attachment surface 38 disposed on a top side thereof to which the leg pad 14 may be secured or mounted. The attachment surface 38 is planar in at least one embodiment and may be configured to attach to the underside of the leg pad 14. In other embodiments, the leg pad 14 and cover 35 may be formed of unitary construction, such as by casting, molding, or 3D printing out of a suitable material such as plastics.

The leg pad assembly 40 also includes at least one guide member, such as a first guide member 32 and a second guide member 33, extending therefrom. For instance, the guide members 32, 33 may extend through a hole or aperture in the leg pad assembly 40, extend from a surface of the leg pad assembly 40, and may be formed of a unitary piece with the leg pad assembly 40 such as by casting, molding or 3D printing. The first and second guide members 32, 33 extend from the leg pad assembly 40 and through the first and second slots 29, 31, respectively, of the frame 23. Therefore, the guide members 32, 33 connect the leg pad assembly 40 and frame 23. This is a movable connection, since the guide members 32, 33 may have a fixed position in the leg pad assembly 40 but are movable relative to the frame 23, such as by sliding or rolling along said slots 29, 31.

For instance, as shown in FIGS. 6A-6C, the cover 35 of the leg pad assembly 40 may include at least one side extending from the attachment surface 38 such as at least one side wall 36 and a front wall 37. Each side wall 36 may be configured to correspond to a different frame arm 24*a*, 24*b*, and may be positioned in spaced apart relation thereto in the assembly 20, such as but not limited to parallel. Each side wall 36 may include at least one aperture, and preferably a plurality of apertures 34*a*, 34*b* that are configured to receive and retain a guide member 32, 33 therethrough. For instance, a first aperture 34*a* may be dimensioned to receive a first guide member 32 and a second aperture 34*b* may be dimensioned to receive a second guide member 33. The guide members 32, 33 may be movably retained within the apertures 34*a*, 34*b* so they are permitted to rotate about their axes within the apertures 34*a*, 34*b*. For instance, the guide members 32, 33 may be fixed in position relative to the cover 35, but may freely rotate within the apertures 34*a*, 34*b*. Accordingly, the guide members 32, 33 may include a bearing surface at their exterior to reduce friction and enhance movement. The first and second apertures 34*a*, 34*b* may be positioned anywhere along the side wall 36 in any configuration that allows them to align with some portion of the first and second slots 29, 31, respectively, when the cover 35 is disposed over the frame 23. In other embodiments, the guide members 32, 33 may extend from a surface of side wall 36 of the cover 35.

The cover 35 may also include a front wall 37 extending from a forward end of the attachment surface 38 which provides a lip which a practitioner or user may grip to apply maneuver the extension assembly 20. The front wall 37 may be perpendicular to the attachment surface 38, or it may be angled relative thereto, as shown in FIGS. 6A-6C, such as in the forward or rearward direction. The front wall 37 may further include a handle 39 at a terminal end or at any position there along that is configured to facilitate gripping by a user.

As the leg pad assembly 40 is manipulated such as by pulling forward or pushing rearward, the guide members 32, 33 are moved in the corresponding direction. This moves the leg pad assembly 40 relative to the frame 23 since the frame remains stationary, and moves the guide members 32, 33 along the slots 29, 31, respectively. In at least one embodiment, the first guide member 32 may be located above and forward of the second guide member 33 in the leg pad assembly 40, as shown in the Figures. This positioning permits the second guide member 33 to act as a counterweight for the leg pad assembly 40 to prevent it from tipping or rotating about the first guide member 32 as it navigates the various detents 30 of the first slot 29.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. An extension assembly for a leg pad of a procedure chair, said extension assembly comprising:

a forward end and an opposite rearward end;

a frame configured to secure said extension assembly to said procedure chair, said frame having a plurality of frame arms fixed a predetermined distance from one another;

each of said frame arms including a first slot and a second slot each extending along at least a portion thereof, said first slot having a plurality of detents at predefined positions there along, said detents configured to selectively restrict movement of a first guide member slidably inserted in said first slot at said predefined positions, said second slot spaced a fixed distance from said first slot;

a leg pad assembly slidably affixed to said frame;

said first guide member and a second guide member each extending from said leg pad assembly, said first guide member configured to align with said first slot and said second guide member configured to align with said second slot when said leg pad assembly is affixed to said frame;

said first guide member insertable through and movable relative to said first slot, said second guide member insertable through and movable relative to said second slot, said first guide member releasably positionable in each of said detents of said first slot so that movement of said first guide member along said first slot and said second guide member along said second slot correspondingly moves said leg pad assembly relative to said frame; and wherein said extension assembly is adjustable between a stowed vertical position and at least one deployed position, said detents configured to prevent vertical movement of said leg pad assembly in said stowed position and selectively restrict movement of said leg pad assembly in said at least one deployed position relative to said detents.

2. The extension assembly of claim 1, wherein said detents are configured to restrict movement of said leg pad assembly in a direction between said forward end and said rearward end.

3. The extension assembly of claim 1, wherein said first and second slots are parallel to each other.

4. The extension assembly of claim 1, wherein said first and second guide members extend from said leg pad assembly in spaced apart relation to one another.

5. The extension assembly of claim 1, wherein said first guide member is located closer to said forward end and said second guide member is located closer to said rearward end.

6. The extension assembly of claim 1, wherein said first and second guide members are rotatably retained within said leg pad assembly.

7. The extension assembly of claim 1, wherein said detents are configured to receive and removably restrain at least a portion of said first guide member.

8. The extension assembly of claim 7, wherein each of said detents further comprises at least one forward edge at least partially defining each of said detents.

9. The extension assembly of claim 8, wherein at least one of said detents further comprises a semi-circular configuration.

10. The extension assembly of claim 8, wherein at least one of said detents further comprises a forward edge and an opposite rearward edge collectively defining said at least one of said detents.

11. The extension assembly of claim 10, wherein said forward and rearward edges of said at least one detent have substantially the same height.

12. The extension assembly of claim 8, wherein at least one of said detents further comprises a forward edge and an opposite side opening to an incline section of said first slot.

13. The extension assembly of claim 1, wherein each of said first guide member and said second guide members are selected from the group consisting of a pin, roller, peg, rod, wheel, bolt, and bearing.

14. The extension assembly of claim 1, wherein each of said frame arms are configured to secure to said procedure chair at said rearward end of said extension assembly.

15. The extension assembly of claim 14, wherein each of said frame arms further comprises a frame pivot point at said rearward end, said extension assembly rotatable about said frame pivot point between said stowed vertical direction and said at least one deployed position.

16. The extension assembly of claim 15, said procedure chair further comprising at least one deployment track configured to move said extension assembly forward and upward relative to said procedure chair from said vertical stowed position to said at least one deployed position, said frame pivot point of each of said frame arms configured to secure to said at least one deployment track.

17. The extension assembly of claim 1, wherein said leg pad assembly is dimensioned to correspond to at least a portion of said frame and is disposable in overlapping proximity to said frame.

18. The extension assembly of claim 1, wherein said leg pad assembly further comprises a cover disposable in overlapping proximity to said frame and having an attachment surface configured to secure to said leg pad.

19. The extension assembly of claim 1, wherein said leg pad assembly is configured to be manually movable between said rearward end and said forward end.

* * * * *